US007077394B2

(12) United States Patent
Fuchs

(10) Patent No.: US 7,077,394 B2
(45) Date of Patent: Jul. 18, 2006

(54) METHOD OF AND APPARATUS FOR GATHERING STACKS OF SHEETS AND THE LIKE

(75) Inventor: Ferdinand Fuchs, Nürtingen (DE)

(73) Assignee: Kugler-Womako GmbH, Nurtingen (DE)

( * ) Notice: Subject to any disclaimer, the term of this patent is extended or adjusted under 35 U.S.C. 154(b) by 214 days.

(21) Appl. No.: 10/400,065

(22) Filed: Mar. 27, 2003

(65) Prior Publication Data

US 2004/0218996 A1 Nov. 4, 2004

(30) Foreign Application Priority Data

Mar. 28, 2002 (DE) ..... 102 14 341

(51) Int. Cl.
*B42B 5/12* (2006.01)

(52) U.S. Cl. ..... 270/52.17; 270/58.07; 270/58.08; 140/92.3; 412/39

(58) Field of Classification Search ..... 270/52.17, 270/58.07, 58.08; 412/6, 7, 16, 33, 38, 39, 412/40; 140/92.3, 92.4
See application file for complete search history.

(56) References Cited

U.S. PATENT DOCUMENTS 4,157,821 A * 6/1979 Fabrig ..... 270/58.07
4,232,858 A * 11/1980 Fabrig ..... 270/58.07
4,403,896 A * 9/1983 Fabrig ..... 412/38
4,537,545 A * 8/1985 Kunzmann ..... 412/7
4,758,125 A * 7/1988 Wahl ..... 412/39
6,056,495 A * 5/2000 Doyle et al. ..... 412/39
2003/0183298 A1* 10/2003 Fuchs ..... 140/92.3

FOREIGN PATENT DOCUMENTS

DE 18 17 815 A 2/1972
DE 26 53 759 A1 6/1978
DE 28 04 180 A1 8/1979
DE 32 20 814 A 12/1983

* cited by examiner

*Primary Examiner*—Patrick Mackey
(74) *Attorney, Agent, or Firm*—Venable LLP; Robert Kinberg; Catherine M. Voorhees

(57) ABSTRACT

The method and the apparatus of the invention serve to shift at least some sheets of successive stacks of overlapping sheets so that the originally straight holes which are provided along one marginal portion of each stack are converted into arcuate passages adapted to more readily receive the convolutions of spirals serving to pivotably couple the sheets of the stacks to each other. This is accomplished by inserting into one or both ends of some or all of the holes a discrete pin-shaped displacing member which is thereupon pivoted to thus shift at least some of the sheets relative to the neighboring sheets. In order to speed up the shifting of sheets, the displacing member or members is or are pivoted during withdrawal from the respective hole or holes to move its or their tips along arcuate paths at least approximating the curvatures of the convolutions which are to be introduced into the thus converted holes.

18 Claims, 5 Drawing Sheets

METHOD OF AND APPARATUS FOR GATHERING STACKS OF SHEETS AND THE LIKE

CROSS-REFERENCE TO RELATED CASES

The present application claims the priority of the commonly owned copending German patent application Serial No. 102 14 341.2 filed Mar. 28, 2002. The disclosure of the aforementioned German patent application, as well as those of each US and foreign patent and patent application identified in the specification of the present application are incorporated herein by reference.

BACKGROUND OF THE INVENTION

The present invention relates to improvements in methods of and in apparatus for gathering piles or stacks of sheets, panels, laminae and analogous flat objects preparatory to pivotally connecting the stacked objects to each other by the convolutions of coil springs or analogous coupling or connecting devices.

It is known to assemble sheets of lined or otherwise imprinted paper or the like into stacks, to provide the sheets with rows of perforations which are adjacent to one longitudinal or transverse marginal portion of the stack, and to use a length of a coil spring which pivotably connects the sheets of the stack to each other. The convolutions of the coil spring extend through groups of aligned holes in the stack and the ends of the inserted coil spring are often deformed and/or otherwise treated to ensure that the coil spring cannot be accidentally separated from the stack.

It is also known to shift the sheets of an assembled stack relative to each other prior to introduction of the coil spring. The purpose of such shifting is to impart to each through hole of the stack a shape which is more likely to permit unimpeded and predictable introduction of convolutions of the coil spring. This can be accomplished by imparting to each hole a shape (e.g., a V-shaped outline) having a configuration more closely approximating that of the convolutions than a straight hole. The presently known means for changing the configurations of holes in the stacks of sheets prior to the introduction of the coil spring include at least one pin- or stud-shaped sheet shifting element, normally at least one row of such elements, which is or which are introduced into the originally straight hole or holes and is or are thereupon pivoted to thus shift at least some sheets of the stack relative to the other sheet or sheets. The thus manipulated stack is ready to be assembled with a coil; this involves the introduction of successive convolutions of the coil at one end of the spine of the stack and rotation of the coil so that its convolutions advance toward the other end of the spine. Deformation of holes in the spine of the stack prior to assembly with the coil is intended to facilitate the threading of convolutions into the spine even if the diameters of perforations in the individual sheets, panels or layers of the stack only slightly exceed the diameter of the wire or other material of which the coil is made.

Apparatus of the just outlined character can be utilized in semiautomatic or fully automated production lines for the making of legal pads, other pads, calendars, brochures or analogous commodities. In many instances, the production line further comprises means for assembling a succession of stacks by subdividing webs, strips or large panels of paper, foil, cardboard or the like into sheets of desired size and/or shape. Such subdivision can take place simultaneously with the making of rows of perforations and/or with the application of printed matter to selected sheets or to each sheet of the stack. The thus treated sheets are gathered into piles or stacks each of which contains a predetermined number of sheets, and the perforations of the thus gathered sheets of the stack overlie each other to jointly form a row of elongated holes extending all the way from one to the other outermost sheet of the stack. This is a prerequisite for the introduction of the convolutions of a coil spring which, when properly inserted, permits pivoting of one or more sheets of the thus obtained commodity relative to the other sheet or sheets.

German patents Nos. 2 653 759 A1 and 2 804 180 A1 disclose methods of and apparatus for assembling the sheets into stacks of overlapping sheets in such a way that the holes consisting of perforations extending along registering marginal portions of the sheets are ready to receive the convolutions of a coil spring. The patented apparatus comprise two confronting rows of studs or pins which face each other and means for moving the two rows of such component parts relative to (toward and away from) each other. Insertion of the two rows of studs or pins into the holes of a stack of sheets is followed by a pivoting of the studs or pins with the result that each originally straight hole of the stack is converted into a substantially V-shaped passage for the convolutions of the coil. Such conversion of the originally straight holes is followed by extraction of the pins or studs from the stack and the threading of successive arcuate convolutions of the coil into successive V-shaped passages.

OBJECTS OF THE INVENTION

An object of the instant invention is to provide a novel and improved method of manipulating the stacks of overlapping perforated sheets in such a way that the shapes of the row of originally straight holes in one marginal portion of each stack can be altered for convenient reception of a coil spring in a series of steps the number of which is less than the number of steps in a conventional method.

Another object of the present invention is to provide a method which renders it possible to ensure more predictable and more rapid assembly of treated stacks with the convolutions of coil springs or analogous connectors.

A further object of the invention is to provide a method which can be practiced in connection with the making of steno pads, legal pads, other types of pads, calendars, brochures and analogous commodities wherein the sheets of the stack are pivotably connected to each other by the helical convolutions of a coil in a highly predictable manner and with a minimal number of rejects.

An additional object of the invention is to provide a novel and improved apparatus for the practice of the above outlined method.

Still another object of the invention is to provide the apparatus with novel and improved means for shaping the holes in stacks of overlapping paper sheets or the like preparatory to threading of the convolutions of coil springs which are to hold the stacks of sheets in a properly assembled condition.

A further object of the invention is to provide novel pads, calendars or analogous commodities wherein the sheets are joined in accordance with the above outlined novel method and by resorting to the novel apparatus.

SUMMARY OF THE INVENTION

One feature of the present invention resides in the provision of a method of displacing at least some sheet-like components (hereinafter called sheets for short) of a pile or stack (hereinafter called stack), wherein the sheets have rows of at least partially registering perforations or holes (hereinafter called holes), preparatory to joining of the sheets by a connector (such as an elongated coil spring) including a plurality of sections (such as the convolutions of the coil spring) having shapes departing from straight. The improved method comprises the steps of inserting into at least one hole of the row at least one elongated member of a sheet shifting implement, thereupon withdrawing the at least one member from the at least one hole, and changing the orientation of the at least one member at least in the course of the withdrawing step with attendant or resulting displacement of the at least some sheets of the stack such that the at least one hole assumes a configuration which matches or at least closely approximates the shapes of the sections of the connector.

The holes of the rows are or can be at least substantially straight prior to the inserting step. In many instances, the sections of the connector have arcuate shapes, e.g., if the connector includes a coil spring or spiral having coaxial convolutions each of which can constitute one of the aforementioned sections. If the connector is a coil spring, the orientation changing step (i.e., the shifting of some or all of sheets of the stack relative to the other sheets) includes pivoting the at least one member about an axis which is at least substantially parallel to the common axis of the convolutions upon introduction of the coaxial convolutions into the holes of the sheets subsequent to the orientation changing step. Such orientation changing step can further comprise pivoting the at least one member of the shifting implement simultaneously with the aforementioned pivoting step about a second axis which is at least substantially normal to the first mentioned axis.

The method can further comprise the step of positioning at an exposed edge face of the stack the surface of a pattern which serves to limit the extent of displacement of sheets of the stack at the treating station in response to the orientation changing step. This ensures an even more predictable shifting of the sheets relative to each other.

If the shifting implement has a plurality of elongated members, the inserting step preferably includes introducing each member of the shifting implement into a different hole of each row and the withdrawing step includes simultaneously withdrawing the plurality of members from the respective holes. The orientation changing step of such method includes simultaneously changing the orientations of the plurality of members.

As a rule, each stack arriving at the treating (sheet displacing) station has a row of at least partially registering holes each provided with a first and a second open end. The inserting step of the method of treating such stacks preferably includes employing two shifting implements each having at least one elongated member and introducing the elongated members of the two implements into different open ends of the at least one hole. The withdrawing step of such method can include at least substantially simultaneously withdrawing the two shifting members by way of the respective ends of the at least one hole, and the orientation changing step includes changing the orientation of each of the shifting members so that each shifting member causes a displacement of the at least some sheets of the stack. More specifically, the orientation changing step can include imparting to the two shifting members movements (such as pivotal movements) which are at least substantial mirror images of each other. The inserting step can further include locating the two implements at opposite sides of the stack at the treating station. If the connector includes a spiral having coaxial convolutions which constitute the aforementioned sections, the orientation changing step can include turning the shifting implements about predetermined axes which are at least substantially parallel to the axis of the spiral upon introduction of the convolutions into the holes of the sheets upon completion of the orientation changing step. The latter can further comprise pivoting the shifting implements about an axis which is at least substantially normal to the predetermined axes, and such pivoting step can take place simultaneously with the turning step. The just discussed embodiment of the method can further comprise the step of positioning at an exposed edge face of the stack at the treating station a surface provided on a pattern or template and serving to limit the extent of displacements of the sheets of the stack in response to the orientation changing step which is being carried out by the two shifting members.

Another feature of the present invention resides in the provision of an apparatus for displacing at least some sheet-like perforated components (hereinafter called sheets) of stacks or piles (hereinafter called stacks) wherein the perforations of the sheets define rows of at least partially registering holes. The apparatus serves to prepare the stacks for the joining of their sheets by connectors each of which includes a plurality of sections (such as convolutions) having shapes departing from straight and each arranged to enter a discrete hole of the stack. The improved apparatus comprises shifting means disposed at a treating station and including at least one shifting implement having at least one elongated shifting member, means for positioning stacks at the treating station with freedom of sliding movement of at least some of the sheets of the stack at the treating station relative to each other, and means for inserting the elongated shifting member of the at least one shifting implement into a selected hole of the stack at the treating station and for thereupon withdrawing the elongated member from the selected hole. The apparatus further comprises means for changing the orientation of the at least one shifting implement during withdrawal from the selected hole to thus displace the at least some sheets of the stack in such a way that the selected hole assumes a configuration at least approximating the shapes of sections of the connector which is introduced upon completion of the orientation changing step.

The sheets can consist of paper, cardboard, metallic foil, plastic material and/or other material, and the sheets of successive stacks can be joined by connectors which can be made of a metallic, a plastic or other suitable material and can include arcuate connectors such as the convolutions of a helical coil or spiral. The shifting means can include at least one implement having a plurality of elongated shifting members each of which is arranged to enter a different hole of the stack at the treating station.

The perforations of sheets in each stack can define a row of preferably equidistant holes each having a first and a second open end. The shifting means of the apparatus for the manipulation of such stacks can include two implements (particularly two substantially comb-shaped implements) each having at least one elongated member, and the inserting means of such apparatus can include means for introducing the member of each implement into a different end of the selected hole of the stack at the treating station and for thereupon at least substantially simultaneously withdrawing the elongated members. The orientation changing means of such apparatus can include means for at least substantially simultaneously changing the orientation of the implements during withdrawal from the selected hole. If the sheets of the stacks are to be joined by connectors each having a plurality of sections in the form of at least substantially coaxial convolutions, the orientation changing means can include means for turning the implements about predetermined axes which are at least substantially parallel to the common axis of the convolutions upon threading of the convolutions into the holes of the stack subsequent to withdrawal of the elongated members of the implements from the selected hole. The elongated members of such implements can be provided with tips which are at least substantially tangential to and spaced apart from the respective predetermined axes. The orientation changing means of the just described apparatus can further include means for moving the implements, during withdrawal of the elongated members from the selected hole of the stack at the treating station, relative to a further axis which is at least substantially normal to the predetermined axes. The implements can be arranged to pivot about the further axis.

The just described embodiment of the improved apparatus can be constructed and assembled in such a way that each of its implements comprises two series or sets of elongated members each of which is arranged to enter a different hole of the stack at the treating station; the orientation changing means then includes means for moving the implements in different directions, and such moving means can be arranged to move the implements along paths which are at least substantial mirror images of each other.

If the improved apparatus comprises sheet shifting means having a single shifting implement with one or more elongated members, its construction can be simplified by employing less complex inserting/withdrawing means and less complex orientation changing means. As already mentioned hereinbefore, each shifting implement can resemble a comb having an elongated back carrying a row of elongated prong-shaped members which are or which can be equidistant from each other. The back of the comb can be moved forwardly and backwards as well as turned about an axis which is parallel to its longitudinal direction. The means for moving the comb can include arms, levers, motor means, resilient elements and/or other suitable devices.

The means for feeding successive stacks to the treating station, for properly locating the stacks at the treating station, and for removing treated stacks from such station can include an indexible turret and/or other suitable conveyor means.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
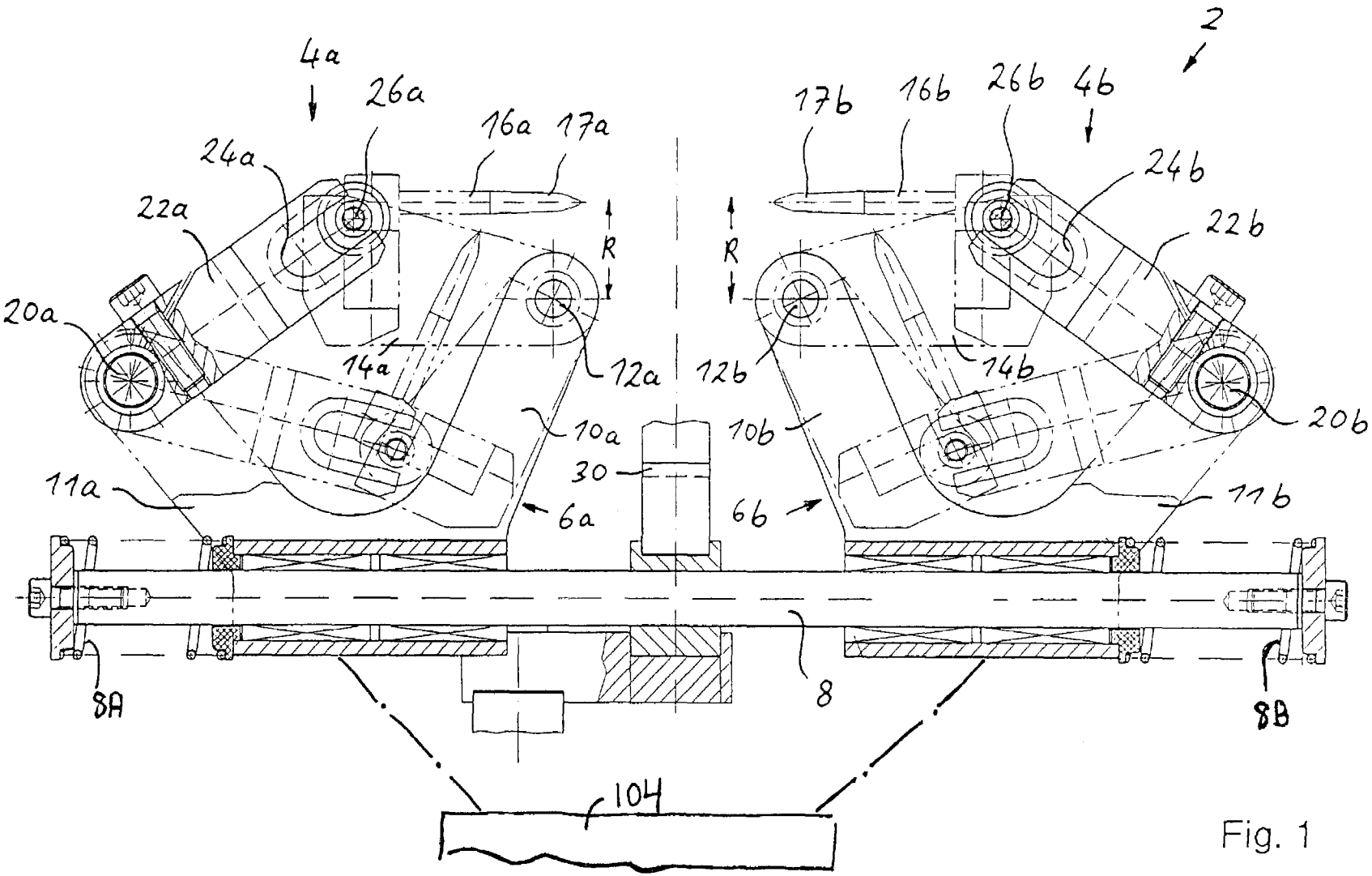
FIG. 1 is a fragmentary sectional view of one embodiment of the improved apparatus which is shown with its mobile parts in open positions so that the apparatus is ready to receive a stack of registering sheets.
Figure 2:
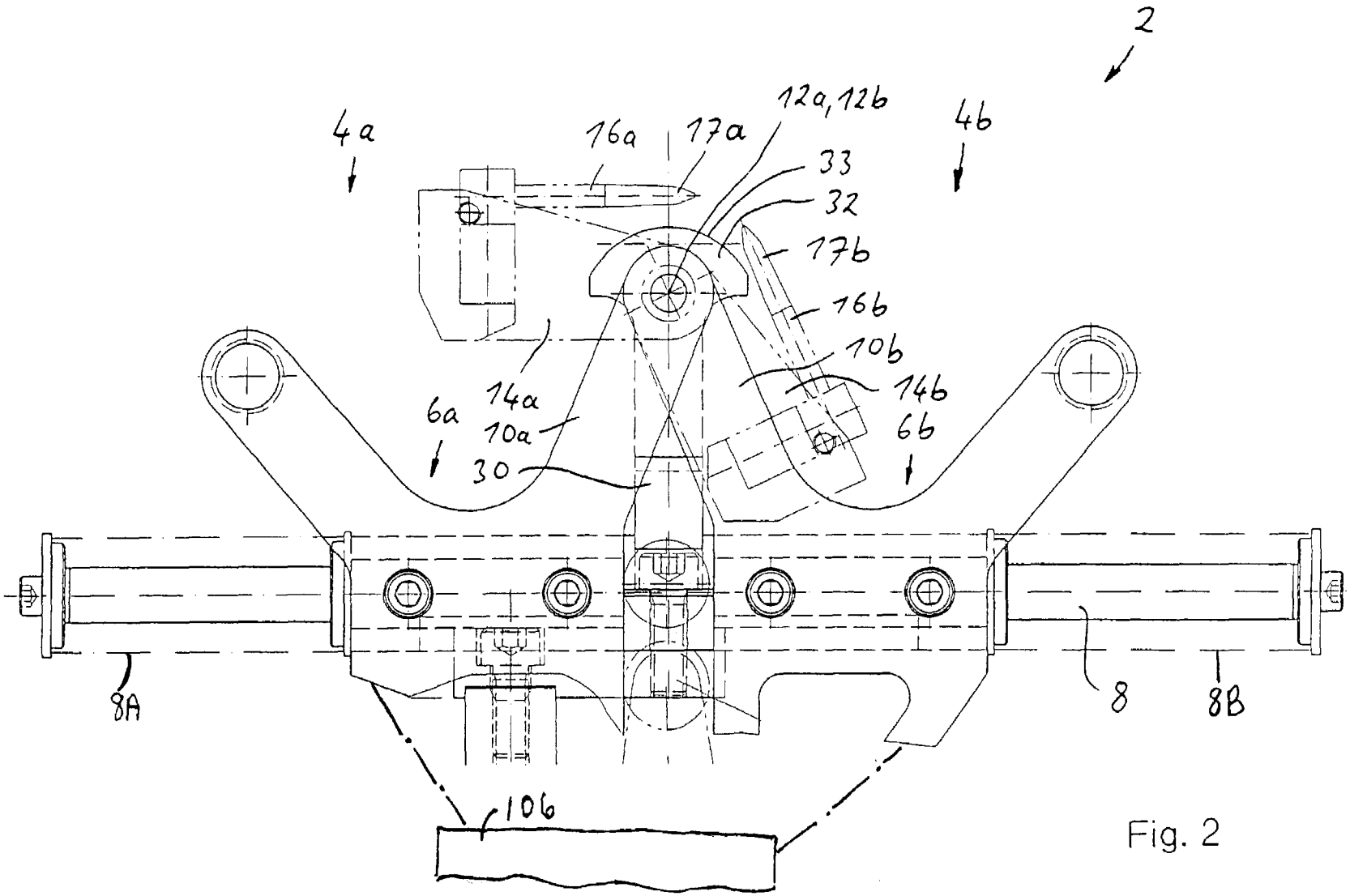
FIG. 2 shows the apparatus of FIG. 1 but with its mobile parts in closed or operative positions.

Referring first to FIGS. 1 and 2, there is shown an apparatus 2 which serves to displace certain sheets or all sheets of a stack or pile 50 (see FIGS. 3, 4 and 6) of overlapping sheets, e.g., sheets of paper, cardboard, metallic foil, plastic foil or the like. The manner in which the sheets are stacked and provided with rows of holes or perforations is disclosed, for example, in commonly owned copending U.S. patent application Ser. No. 10/396,705 filed Mar. 26, 2003 by Ferdinand Fuchs for "APPARATUS FOR COUPLING STACKED SHEETS". When a stack 50 is fully assembled for treatment in the apparatus 2 of the present invention, one (51) of its marginal portions (namely the so-called spine best shown in FIG. 6) is provided with a row of straight holes each consisting of fully registering perforations formed in the individual sheets of the stack. The purpose of the improved apparatus 2 is to convert each straight hole into an arcuate hole 52 (refer to FIG. 6) which has a curvature corresponding to or at least approaching that of a convolution 54 of a connector, such as a coil spring, which is utilized to pivotably couple or join the sheets of the thus deformed stack 50 to each other. The finished products can constitute memo pads, other stationery products, calendars, advertising brochures or the like. The means and manner with which and in which the convolutions 54 of a coil spring (spiral) can be rapidly and predictably threaded into the arcuate holes 52 of treated stacks 50 is or can be the same as disclosed in the aforementioned copending patent application Ser. No. 10/396,705.

The apparatus 2 comprises two supports 4*a*, 4*b* which respectively include substantially V-shaped bases 6*a*, 6*b* slidable along a common preferably horizontal shaft 8. The latter is mounted in or on a frame (not shown) and further carries resilient elements 8A, 8B in the form of coil springs which serve to yieldably urge the followers of the bases 6*a*, 6*b* toward each other. The supports 4*a*, 4*b* of the illustrated apparatus 2 are or can be mirror images of each other with reference to a plane which is normal to the axis of the shaft 8 and is located between the bases 6*a*, 6*b*. These bases respectively comprise first legs 10*a*, 10*b* which slope toward each other, and second legs 11*a*, 11*b* which slope away from each other. The free ends of the first legs 10*a*, 10*b* include or form part of hinges 12*a*, 12*b* having parallel horizonal pintles which are normal to and spaced apart from the shaft 8. The hinges 12*a*, 12*b* respectively mount first pivotable levers 14*a*, 14*b* having free end portions each carrying at least one elongated stud- or pin-shaped shifting member 16*a*, 16*b* with a free end portion or tip 17*a*, 17*b* respectively adjacent to but spaced apart from the hinges 12*a*, 12*b*. The distances between the tips 17*a*, 17*b* and the respective hinges 12*a*, 12*b* are shown at R. Each of these distances R is measured between the axis of the respective shifting member 16*a*, 16*b* and the axis of the respective hinge 12*a*, 12*b*.

The free ends of the second legs 11*a*, 11*b* of the respective bases 6*a*, 6*b* carry second hinges 20*a*, 20*b* having axes which are at least substantially parallel to those of the respective first hinges 12*a*, 12*b*. The hinges 20*a*, 20*b* pivotably mount second levers 22*a*, 22*b*. The free ends of the levers 22*a*, 22*b* are respectively provided with longitudinally extending open slots 24*a*, 24*b* for guide rollers 26*a*, 26*b*, respectively. The axes of these rollers are parallel to those of the hinges 12*a*, 12*b* and 20*a*, 20*b*. The rollers 26*a*, 26*b* are respectively mounted at the free ends of the first levers 14*a*, 14*b* adjacent the respective elongated shifting members 16*a*, 16*b*.

The second levers 22*a*, 22*b* are pivotable by suitable drive means one of which is shown schematically at 122*a*. Such pivoting of the levers 22*a*, 22*b* entails appropriate pivoting of the first levers 14*a*, 14*b* and hence of the respective elongated shifting members 16*a*, 16*b*. Each of the shifting members 16*a*, 16*b* is pivotable between a substantially horizontal first position in which their tips 17*a*, 17*b* are adjacent to and confront one another but are still spaced apart from each other (the axis of the member 16*a* then coincides or substantially coincides with that of the member 16*b*), and a second position in which the respective tips 17*a*, 17*b* slope upwardly away from the shaft 8. The distance between the tips 17*a*, 17*b* increases in response to pivoting of the shifting members 16*a*, 16*b* from the first to the second positions. FIG. 1 shows the two shifting members 16*a*, 16*b* by dot-dash lines in each of their first and second positions. On the other hand, FIG. 2 shows the shifting member 16*a* in its first position and the shifting member 16*b* in its second position.

Figure 6:
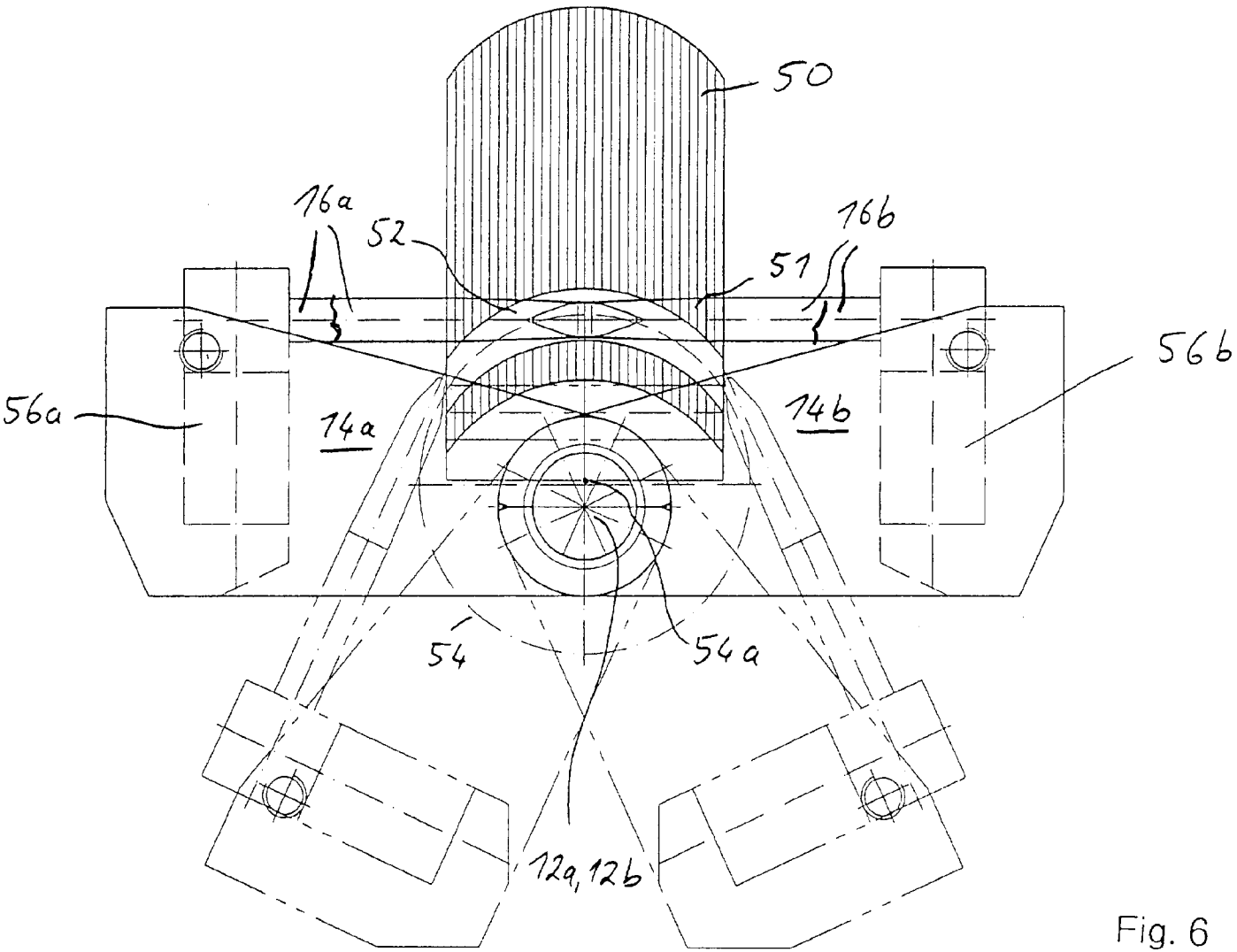
FIG. 6 is a greatly enlarged view of a detail in the apparatus of FIG. 2 and further showing a portion of a stack of overlapping sheets with a deformed hole as it appears upon extraction of the elongated members of two shifting implements and with one convolution of a spiral-shaped connector in the deformed hole of the stack.

Each of FIGS. 1 and 2 shows a single elongated shifting member 16*a* and a single elongated shifting member 16*b*. However, the apparatus 2 actually employs two shifting implements which are respectively borne by the hinges 12*a*, 12*b* and respectively include two or more aligned shifting members 16*a*, 16*b*. For example, each such shifting implement can include one of the levers 14*a*, 14*b* and a row of shifting members 16*a*, 16*b*, one for each hole of the stack 50 at the treating station for the apparatus 2. This is shown in FIG. 6 wherein the front shifting members 16*a*, 16*b* are partly broken away to respectively show the shifting members 16*a*, 16*b* immediately behind them. The aligned shifting members 16*a*, 16*b* of the respective rows on the levers 14*a*, 14*b* of the corresponding shifting implements are equidistant from each other if the spacing between the holes 52 in or at the spines 51 of the stacks 50 is uniform.

FIGS. 1 to 5 further show a carrier 30 which is disposed between the supports 4*a*, 4*b* and carries a substantially mushroom-shaped head or pattern 32 disposed at the level of the hinges 12*a*, 12*b* and having a part cylindrical exposed surface 33 with a curvature corresponding to that of a convolution 54 of the coil spring shown in FIG. 6. The surface 33 limits the extent of shifting of the sheets of a stack 50 at the treating station of FIG. 5 relative to each other by the tips 17*a*, 17*b* of pivoting shifting members 16*a*, 16*b* when the apparatus 2 is in the process of preparing the stack (or a series of two or more stacks) for the introduction of convolutions 54 of discrete coil springs or analogous connectors.

FIG. 1 shows the apparatus 2 in its open position, i.e., the supports 4*a*, 4*b* are spaced apart from each other in response to actuation of a schematically shown prime mover 104 which has moved the tubular followers of the V-shaped bases 6*a*, 6*b* along the shaft 8 and away from each other, i.e., against the opposition of the coil springs 8A, 8B so that the two supports are maintained at a maximum distance from each other. On the other hand, FIG. 2 shows the supports 4*a*, 4*b* in their operative positions in which their bases 6*a*, 6*b* are spaced apart at a minimum distance from each other; these bases can assume such positions under the bias of the coil springs 8A, 8B in response to deactivation of the prime mover 104. The axis of the hinge 12*a* then coincides with that of the hinge 12*b*. The legs 10*a*, 10*b* are slightly offset relative to each other (as seen in the axial direction of the hinges 12*a*, 12*b*) so that they do not collide when the supports 4*a*, 4*b* are caused to move from the positions of FIG. 1 to those shown in FIG. 2. This also applies for the carrier 30 of the pattern 32, i.e., the position of the carrier 30 relative to the paths of movement of the legs 10*a*, 10*b* and the bases 6*a*, 6*b* is selected with a view to ensure that the hinges 12*a*, 12*b* can reach the operative positions shown in FIG. 2. The center of curvature of the largely convex (part cylindrical) surface 33 of the pattern 32 is located on or close to the common axis of the hinges 12*a*, 12*b* when the supports 4*a*, 4*b* reach the positions shown in FIG. 2.

The position of the right-hand shifting member 16*b* of FIG. 2 departs from the actual position which this member assumes in response to closing of the apparatus 2. In its actual position, the shifting member 16*b* of FIG. 2 is a mirror image of the other member 16*a* and the movements of members 16*a*, 16*b* to and from their extended or operative positions (in which they extend into an initially straight hole of the stack 50 at the treating station—see FIG. 5) are preferably identical not only when they are caused to move into a hole but also during withdrawal from the hole with attendant shifting of at least some sheets of the stack 50 relative to each other.

Figure 3:
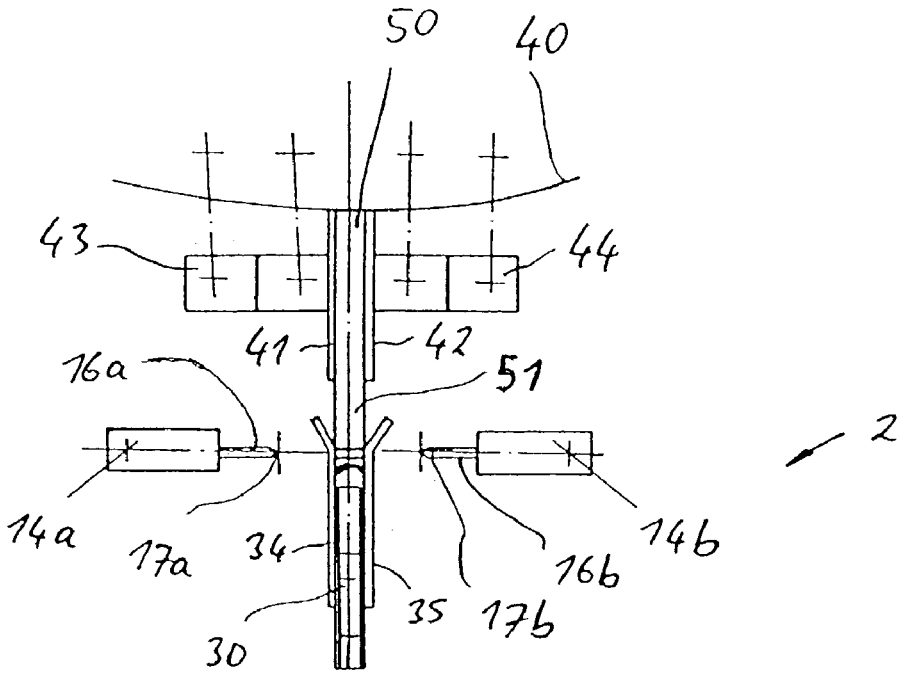
FIG. 3 is a schematic view of certain parts of the apparatus of FIGS. 1 and 2, with the elongated members of its shifting implements ready to enter a hole in a stack of sheets which are held at the treating station by an indexible turret-shaped conveyor.

FIG. 3 shows schematically a stack 50 at the treating station and the means for positioning the stack relative to the supports 4*a*, 4*b* the levers 14*a*, 14*b* of which are held in the positions corresponding to those shown in FIG. 1. The stack positioning means includes a turret 40 which is indexible about a horizontal axis normal to that of the shaft 8 and includes an array of equidistant radial pockets having panels 41, 42 adapted to frictionally hold between them discrete stacks 50 in such a way that the stacks are indexed with the turret 40. However, the linkages 43, 44 which movably couple the panels 41, 42 to the body of the turret 40 are set up to open successive pockets at the station where such pockets receive fresh stacks 40, to permit requisite shifting of certain sheets or all sheets of a stack at the treating station, and to permit removal of stacks at the station where the stacks are separated from the turret. Reference may be had again to the commonly owned copending U.S. patent application Ser. No. 10/396,705 which describes and shows a presently preferred apparatus for perforating the sheets of successive stacks and for threading the convolutions of coil springs into the thus obtained holes of the stacks.

FIG. 3 further shows two plate-like lateral guides 34, 35 which flank the carrier 30 and have funnel-shaped enlargements at the level of the two rows of shifting members 16*a*, 16*b*. The marginal portion (spine) 51 of the stack 50 at the treating station of FIG. 3 is located between the enlargements of the guides 34, 35 and the holes of the row of holes at the spine 51 are in register with the tips 17*a*, 17*b* of the shifting members 16*a*, 16*b*. These tips are ready to enter the respective open ends of the holes between them.

Figure 4:
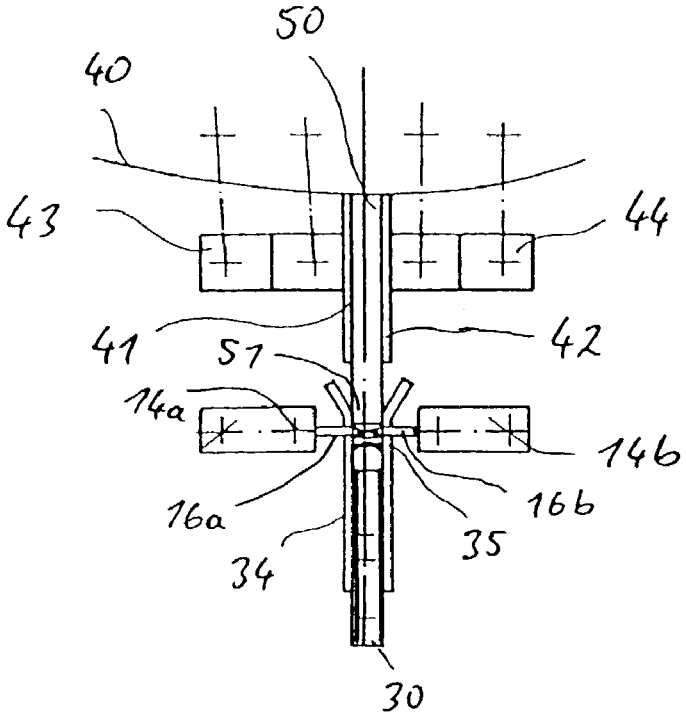
FIG. 4 shows the structure of FIG. 3 but with the tips of the elongated members received in the hole of the stack.

FIG. 4 shows the shifting members 16*a*, 16*b* upon introduction of their tips 17*a*, 17*b* into the holes of the spine 51 at the treating station. Such movements of the shifting members 16*a*, 16*b* involve movements of the supports 4*a*, 4*b* from the positions of FIG. 1 to those shown in FIG. 2 and simultaneous pivoting of the members 16*a*, 16*b* to their horizontal positions so that the tips 17*a*, 17*b* can enter the respective open ends of the holes 52 between them. The extent of movement of the shifting members 16*a*, 16*b* toward each other is or can be such that the tips 17*a*, 17*b* are adjacent each other in the middle of the respective hole 52. A collision between the tips 17*a*, 17*b* in a hole 52 can be avoided by ensuring that each shifting member 16*a* is slightly offset relative to the associated shifting member 16*b*.

Figure 5:
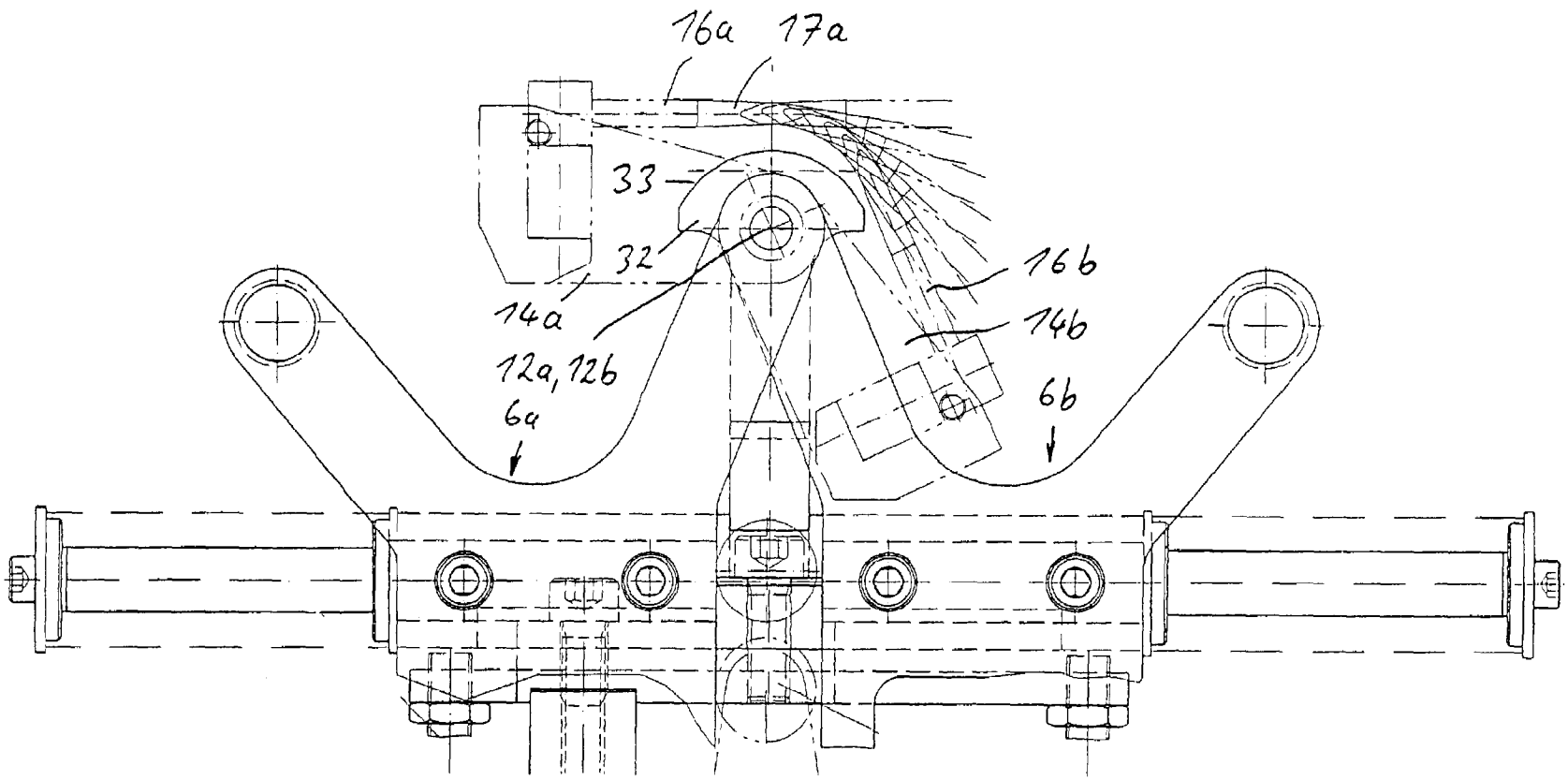
FIG. 5 is a view similar to that of FIG. 2 but showing the elongated member of one shifting implement in several different positions during withdrawal of its tip from the hole of the stack of sheets at the treating station.

The next step of the orientation changing operation involves a pivoting of the levers 14*a*, 14*b* from the positions shown in FIG. 4 (in which the shifting members 16*a*, 16*b* are at least substantially horizontal) to the inclined positions corresponding to that of the lever 14*b* shown in FIG. 5. This causes the tips 17*a*, 17*b* to move along at least substantially mirror symmetrical arcuate paths one of which (namely that for the tip 17*b*) is shown in FIG. 5. It is to be recalled that the movements of each shifting member 16*a* in the apparatus 2 are assumed to be exact or at least substantial mirror images of movements of the associated shifting members 16*b* and vice versa, i.e., the shifting member 16*a* of FIG. 5 is caused to move along a path which is a mirror image of the illustrated path for the shifting member 16*b*.

The just described movements of the tips 17*a*, 17*b* of the shifting members 16*a*, 16*b* shown in FIG. 5 take place while the edge face of the spine 51 of the stack 50 at the treating station abuts the part cylindrical surface 33 of the head or pattern 32 on the carrier 30. The surface 33 limits the extent of shifting of some or all sheets of the stack 50 by the tips 17*a*, 17*b* of the shifting members 16*a*, 16*b* during extraction of the tips 17*a*, 17*b* from the respective holes 52. Thus, the head 32 can be said to constitute or act as a pattern or template which ensures that the ultimate configuration (curvature) of the hole 52 is best suited for predictable reception of a convolution 54 (see FIG. 6) of a coil spring which is thereupon threaded into the holes 52 of the spine 51 in order to pivotably connect or join the sheets to each other.

FIG. 6 shows a portion of a stack 50 with an arcuate hole 52 as it appears upon completion of the sheet shifting operation. This hole is one of a row of equidistant holes in the spine 51 of the stack 50. Each hole 52 consists of a series of discrete perforations, one in each sheet of the stack 50. The fully inserted (horizontal) positions of the two rows of shifting members 16*a*, 16*b* are shown by solid lines, and their retracted (withdrawn) positions are indicated by broken lines. In accordance with an important and advantageous feature of the invention, shifting of some or all sheets of the stack 50 at the treating station is effected during withdrawal of the members 16*a*, 16*b* from the respective holes 52. This entails substantial savings in time, i.e., it is not necessary to provide an extra interval of time for such manipulation of the shifting members 16*a*, 16*b* which is necessary to at least partially conform the configurations of the holes to the shapes of sections (convolutions) 54 of the spiral-shaped connector which is thereupon employed to pivotably couple the sheets of the stack 50 to each other (e.g., in a manner as disclosed in the commonly owned copending patent application Ser. No. 10/396,705).

The tips 17*a*, 17*b* of the shifting members 16*a*, 16*b* shown in FIG. 6 travel along arcs which form part of circles and extend along approximately 45°. The center of each such circle is located on the common axis of the hinges 12*a*,12*b* which, in FIG. 6, assume positions corresponding to those shown in FIG. 2.

If the connector for the sheets of a properly treated stack 50 is a coil spring with convolutions 54 having circular outlines, it is advisable to impart to each of the shifting members 16*a*, 16*b* a composite movement including (a) the aforementioned movements of their tips 17*a*, 17*b* along arcuate paths having their centers on the common axis of the hinges 12*a*, 12*b*, and (b) a simultaneous pivotal movement about the axis of the shaft 8 (i.e., at right angles to the common axis of the hinges 12*a*, 12*b*). This can be accomplished in a simple and inexpensive manner by mounting the substantially V-shaped bases 6*a*, 6*b* in such a way that they can turn (at least within certain limits) about the shaft 8. The extent of pivoting or turning of the shifting members 16*a*, 16*b* about the axis of the shaft 8 depends upon the lead or pitch of the convolutions 54. The exact construction of the means (indicated at 106 in FIG. 2) for turning the members 16*a*, 16*b* about the axis of the shaft 8 forms no part of the present invention; such means can include a suitable crank drive or the like.

It will be appreciated that the bias of the panels 41, 42 upon the outermost sheets (e.g., covers) of the stack 50 shown in FIGS. 4 and 6 is reduced to a value which ensures that the tips 17*a*, 17*b* of the shifting members 16*a*, 16*b* can displace the sheets of the stack 50 at the treating station relative to each other but that the stack continues to dwell in an optimum position for manipulation in the apparatus 2.

Referring again to FIG. 6, it will be seen that the axis 54*a* of the properly inserted convolution 54 is slightly offset relative to the common axis of the hinges 12*a* and 12*b*. Such offset can match or approximate the distance between the arcuate holes 52 and the exposed end face of the spine 51 which abuts the part cylindrical surface 33 of the pattern 32.

FIG. 6 further shows two distancing elements 56*a*, 56*b* which are respectively provided on the levers 14*a*, 14*b* and carry the respective rows of shifting members 16*a*, 16*b*. The distancing elements 56*a*, 56*b* determine the aforediscussed distances R which are shown in FIG. 1. To this end, the apparatus 2 can be furnished with adjustable distancing elements or with two or more sets of elements 56*a*, 56*b* having different lengths and being removably connectable with the respective levers 14*a*, 14*b*.

An advantage which is shared by the method and by the apparatus of the present invention is that the finishing of the stacks 50 for introduction of convolutions 54 or analogous sections of connectors (such as coil springs) can be completed within surprisingly short intervals of time. This enables the production line including the apparatus 2 to turn out a large number of finished pads, blocks, calendars or analogous commodities per unit of time as well as to produce a small number of rejects because the holes 52 can be caused to assume optimum shapes for reception of convolutions or the like at a high frequency.

Another important advantage of the improved method and apparatus is that the shapes of the holes 52 can readily conform, with a high degree of accuracy, to the curvatures of the convolutions 54. This is in contrast to conventional methods and apparatus which, as a rule, are designed to provide the spines of the stacks with holes having a substantially V-shaped outline, i.e., an outline which departs considerably from that of helical convolutions in a coil spring or an analogous connector. The making of holes of the type shown (at 52) in FIG. 6 renders it possible to introduce the convolutions of a coil spring or an analogous connector with a much higher degree of predictability and by resorting to simpler, more compact and more reliable introducing or treading apparatus.

The spine 51 of the stack 50 the treatment of which was completed in a manner as shown in FIG. 6 can remain in contact with the surface 33 of the partly cylindrical pattern 32 on the carrier 30 on its way toward the station where the convolutions 54 of a coil spring or an analogous connector are introduced into the spine 51 of the finished stack, e.g., in a manner as disclosed in the aforementioned commonly owned copending U.S. patent application Ser. No. 10/396,705. This reduces the likelihood of undesirable shifting of the sheets in a finished stack 50 relative to each other, e.g., with the turret 40 of FIGS. 3 and 4 toward the station which accommodates the connector-inserting apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of pivotably coupling the sheets of stacks to each other by means of coil springs or the like and, therefore, such adaptations should and are intended to be comprehended within the meaning and range of equivalence of the appended claims.

What is claimed is:

1. Apparatus for displacing at least some perforated components of stacks, wherein the perforations of the components define rows of at least partially registering holes in the stack, preparatory to joining of the sheets by a connector including a plurality of sections having shapes departing from straight and each arranged to enter a discrete hole of the stack, comprising:

shifting means disposed at a treating station and including at least one shifting implement having at least one elongated member;

means for positioning stacks at said station with freedom of sliding movement of at least some of the components of the stack at said station relative to each other; and means for inserting the elongated member of the at least one shifting implement into a selected hole of the stack at said station and for thereupon withdrawing the elongated member from the selected hole, including means for changing the orientation of the at least one shifting implement during withdrawal from the selected hole to thus displace said at least some components of the stack in such a way that the selected hole has a configuration at least approximating the shapes of sections of the connector.

2. The apparatus of claim 1 for displacing components selected from the group consisting of paper, cardboard, metallic foil and plastic material and to be joined by arcuate connectors, wherein said shifting means includes an implement having a plurality of elongated members each arranged to enter a different hole of a stack at said treating station.

3. The apparatus of claim 1 for displacing at least some components of stacks wherein the perforations of the components define rows of holes in the stack each having a first and a second open end, wherein said shifting means includes two implements each having at least one elongated member and said inserting means includes means for introducing the member of each of said implements into a different end of the selected hole of the stack at said station and for thereupon at least substantially simultaneously withdrawing the elongated members, said orientation changing means including means for at least substantially simultaneously changing the orientation of said implements during withdrawal from the selected hole.

4. The apparatus of claim 3, wherein the sheets of stacks are to be joined by connectors each having a plurality of sections in the form of at least substantially coaxial convolutions and said orientation changing means includes means for turning said implements about predetermined axes which are at least substantially parallel to the common axis of the convolutions upon threading of the convolutions into the holes of the stack subsequent to withdrawal of the members of said implements from the selected hole.

5. The apparatus of claim 4, wherein the members of said implements have tips which are at least substantially tangential to and spaced apart from the respective predetermined axes.

6. The apparatus of claim 5, wherein said orientation changing means further includes means for moving said implements during withdrawal of said members from the selected hole of the stack at said station relative to a further axis which is at least substantially normal to said predetermined axes.

7. The apparatus of claim 6, wherein said implements are pivotable about said further axis.

8. The apparatus of claim 3, wherein each of said implements includes two series of elongated members each arranged to enter a different hole of the stack at said station, said orientation changing means including means for moving said implements in different directions.

9. The apparatus of claim 8, wherein said moving means is arranged to move said implements along paths which are at least substantial mirror images of each other.

10. The apparatus of claim 3, wherein the sheets of the stacks are to be joined by connectors each having, a plurality of sections in the form of at least substantially coaxial convolutions and said orientation changing means includes means for at least substantially simultaneously turning said implements about axes which are at least substantially parallel to the common axis of the convolutions upon threading of the convolutions into the holes of the stacks subsequent to withdrawal of the members of said implements from the holes of the stack at said station.

11. The apparatus of claim 1, wherein the components of the stacks are to be joined by connectors each having a plurality of sections in the form of at least substantially coaxial convolutions and said orientation changing means includes means for turning said at least one implement about a predetermined axis at least substantially parallel to the common axis of the convolutions upon threading of the convolutions into the holes of the stack subsequent to withdrawal of the member of said at least one implement from the selected hole.

12. The apparatus of claim 11, wherein said member of said at least one implement has a tip which is at least substantially tangential to and spaced apart from said predetermined axis.

13. The apparatus of claim 11, wherein said orientation changing means further comprises means for moving said at least one implement during withdrawal of said member from the selected hole relative to a further axis which is at least substantially normal to said predetermined axis.

14. The apparatus of claim 13, wherein said at least one implement is turnable about said further axis.

15. The apparatus of claim 1, further comprising means for limiting the extent of displacement of the components of the stack at said station under the action of said at least one implement.

16. The apparatus of claim 15, wherein said means for limiting includes at least one pattern having a surface with a configuration complementary to the shapes of connector sections which are to enter the holes of the stack upon withdrawal of the elongated member of said at least one implement from the selected hole of the stack at said station.

17. The apparatus of claim 16, wherein said surface of said at least one pattern has a partly cylindrical shape and the selected hole of the stack forms a continuous curve.

18. The apparatus of claim 17, wherein said orientation changing means includes means for pivoting said at least one shifting implement about a predetermined axis, said surface of said pattern having an axis which at least substantially coincides with or is at least substantially parallel to said predetermined axis.

* * * * *